US005231777A

United States Patent [19]

Mattesky et al.

[11] Patent Number: 5,231,777

[45] Date of Patent: Aug. 3, 1993

[54] IRONING BOARD COVER WITH TENSIONED FRONT POCKET AND PERIPHERY

[75] Inventors: Henry Mattesky, Cedar Grove; James J. Gugger, Roselle Park, both of N.J.

[73] Assignee: Herbert Glatt, Morristown, N.J.

[21] Appl. No.: 818,864

[22] Filed: Jan. 10, 1992

[51] Int. Cl.[5] ..... D06F 8300; F16B 45/00

[52] U.S. Cl. ..... 38/140

[58] Field of Search ..... 38/66, 137, 140; 190/1, 190/11, 13 D, 13 E; 2/DIG. 6, 327; 32/66; 108/90, 48, 108, 121; 297/DIG. 6; 24/712; 150/154, 158, 159

[56] References Cited

U.S. PATENT DOCUMENTS

| | | | |
|---|---|---|---|
| 941,430 | 11/1909 | Stone | 38/140 |
| 1,287,597 | 12/1918 | Murray | 38/140 |
| 1,565,373 | 12/1925 | Kohn | 38/140 |
| 1,885,737 | 11/1932 | Lewis | 38/140 X |
| 2,029,856 | 2/1936 | Collette | 38/140 |
| 2,035,245 | 3/1936 | Plotkin | 38/140 |
| 2,119,427 | 5/1938 | Edwards, Sr. | 38/140 |
| 2,179,458 | 11/1939 | Ruttenberg | 38/140 |
| 2,210,601 | 8/1940 | Scalon | 38/140 X |
| 2,418,969 | 4/1947 | Di Gesare | 38/140 |
| 2,730,748 | 1/1956 | Smyth | 38/140 X |
| 2,850,817 | 9/1958 | Rudd et al. | 38/140 |
| 3,007,267 | 11/1961 | Goldsmith | 38/140 |
| 3,049,826 | 8/1962 | Goldsmith | 38/140 |
| 4,557,062 | 12/1985 | Mattesky | 38/140 |
| 4,813,166 | 3/1989 | Drake | 108/90 X |
| 5,084,321 | 1/1992 | Sui | 150/158 X |

FOREIGN PATENT DOCUMENTS

| | | | |
|---|---|---|---|
| 0111248 | 8/1940 | Australia | 38/140 |

*Primary Examiner*—Clifford D. Crowder
*Assistant Examiner*—Ismael Izaguirre
*Attorney, Agent, or Firm*—Omri M. Behr; Matthew J. McDonald

[57] ABSTRACT

A tensionable ironing board cover shaped to fit a flat ironing board. This cover has an upper ironing surface segment which extends over the body and the neck portion of the ironing board, if desired, a pad segment located below the ironing surface segment and attached to it, which pad segment has substantially the same dimensions as the ironing surface segment, a rear pocket, arranged on the rear end of the board, a front pocket, having an upper and a lower surface, arranged on the front end of the ironing segment and located below the pad segment which can receive the front end of the neck of the board, and has a frontal nose edge and rearward edge, longitudinal flaps arranged on the longitudinal edges of the board, and tensioning means for adjustably connecting the nose edge of the front pocket to its the read edge so as to enable the separation between the nose edge and the rear edge to be reduced. This reduction causes the flaps to envelop the board more closely. Preferably, the initial distance between the nose edge of the front pocket and the portion of the rear edge thereof closest to it is between about 10% and about 25% of the length of the longitudinal axis of the cover, suitably, between about 15% and about 20% of the length.

9 Claims, 5 Drawing Sheets

IRONING BOARD COVER WITH TENSIONED FRONT POCKET AND PERIPHERY

BACKGROUND OF THE INVENTION

Field of the Invention

BACKGROUND INFORMATION

Replaceable ironing board covers have been used with ironing boards for decades. Many variations of this product exist. However, the common features of most covers in use today include an upper ironing surface which may, if desired, have heat resistant qualities, and a pad to provide some give during the ironing process and also to provide a means for dissipating steam when this is used. The cover also has a lower nose portion, a lower heel portion, and longitudinal flaps arranged on the longitudinal edges of the upper ironing surface segment. In use, the nose portion is slipped over the nose of the ironing board, the heel portion slipped over the heel of the board and the longitudinal flaps folded around the longitudinal edges of the board. In order to carry out successful ironing however, the cover must be secured to the board in such a way that slipping and sliding during the ironing process are reduced to a minimum, if not entirely eliminated.

Numerous solutions have been proposed for this problem. These solutions vary in their efficacy and cost of manufacture. A very common mode is to provide a circumferential string pocket running from the heel around one side of the longitudinal flap, around the rear portion of the nose segment and back down the other longitudinal flap into the heel. A cord runs through this pocket. When the cord is drawn tight and knotted at both of the ends protruding from the heel the cover is fairly well secured to the board. This simple and well known technique has a number of drawbacks. First it is expensive to produce and second, that if the user is careless and one end of the string slips into the pocket from its exit point in the heel it is an exceedingly difficult and tiresome process to bring it back out again. It would therefore be desirable to provide a securing means which has the same effect as the circumferential string, but does not suffer its disadvantages of cost or inconvenience in the case of misoperation.

SUMMARY OF THE INVENTION

The invention is directed to a readily tensionable ironing board cover shaped to fit a flat ironing board having a body which is relatively wide and having a neck which tapers toward the front end of said body. The novel cover comprises an upper ironing surface segment having a body adapted to extend over the body and the neck portion of said board; if desired, a pad segment located below said ironing surface segment and again if desired, attached thereto, having substantially the same dimensions as said ironing surface segment; a rear pocket, arranged on the rear end of said ironing segment and located below said pad segment and adapted to receive the rear end of said board; a front pocket, having an upper and a lower surface ,arranged on the front end of said ironing segment and located below said pad segment and adapted to receive the front end of the neck of said board, having a frontal nose edge and a rearward edge; longitudinal flaps arranged on the longitudinal edges of said ironing segment intermediate said pockets and adapted to fold around said longitudinal edges of said board; and tensioning means for adjustably connecting the nose edge of said front pocket to the rear edge thereof whereby separation between said nose edge and said rear edge may be reduced and whereby said reduction causes said flaps to envelop said board more closely.

Suitably, the initial distance between the nose edge of said front pocket and the portion of the rear edge thereof most proximate thereto is between about 10% and about 25% preferably between 15% and 20% of the length of the longitudinal axis of said cover.

The tensioning means suitably comprises a ring means attached to the lower surface of said front pocket proximate to the nose edge thereof; at least one strap means, having a free end and an attached end, said attached end being attached to said lower surface of said front pocket proximate to the rear edge thereof, said free end being securely but removably attachable to the segment of said strap means proximate to the attached end thereof, whereby when said free strap end is looped through said ring and attached to said attached end thereof, the distance between the said front edge and the said rear edge of said front pocket is reduced. Thus there may be a single strap located substantially along the longitudinal axis of the cover, a pair of straps, one each attached proximate to the junction of the rear edge of the pocket with the longitudinal flaps on each side, or several straps with one edge attached spaced along the rear edge of the front pocket.

Suitably, the removable attachment means may comprise at least one hook and eye pair located respectively on the free and the attached end of said strap. Alternatively it may comprise at least one snap fastener and counterpart snap fastener head pair located respectively on the free and the attached end of said strap. Preferably, it comprises a pair of mutually interacting and separably attachable surfaces located respectively on the free and the attached end of said strap, such as a Velcro® pair.

DESCRIPTION OF THE PREFERRED EMBODIMENTS

Figure 1:
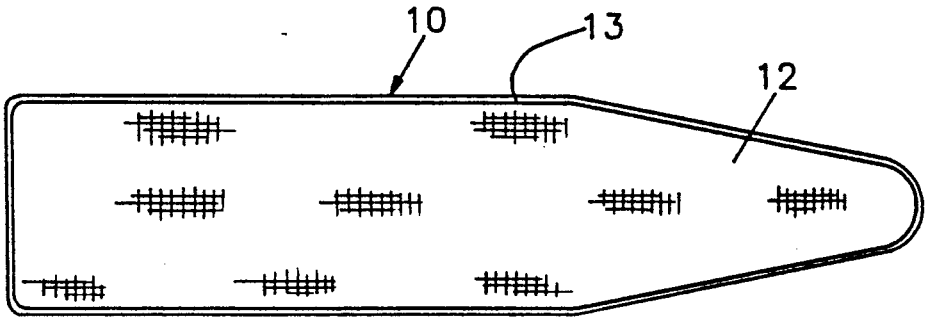
FIG. 1 is a downward plan view of the upper ironing surface segment of the board.
Figure 2:
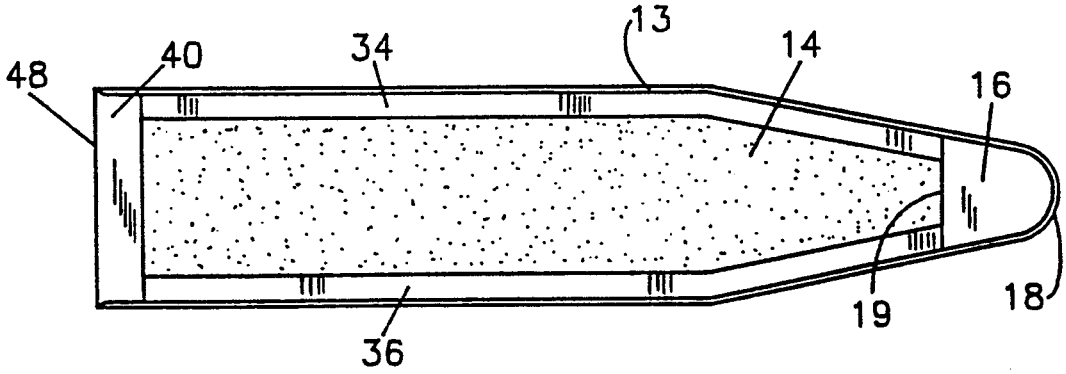
FIG. 2 is a upward plan view of the cover of FIG. 1.
Figure 4:
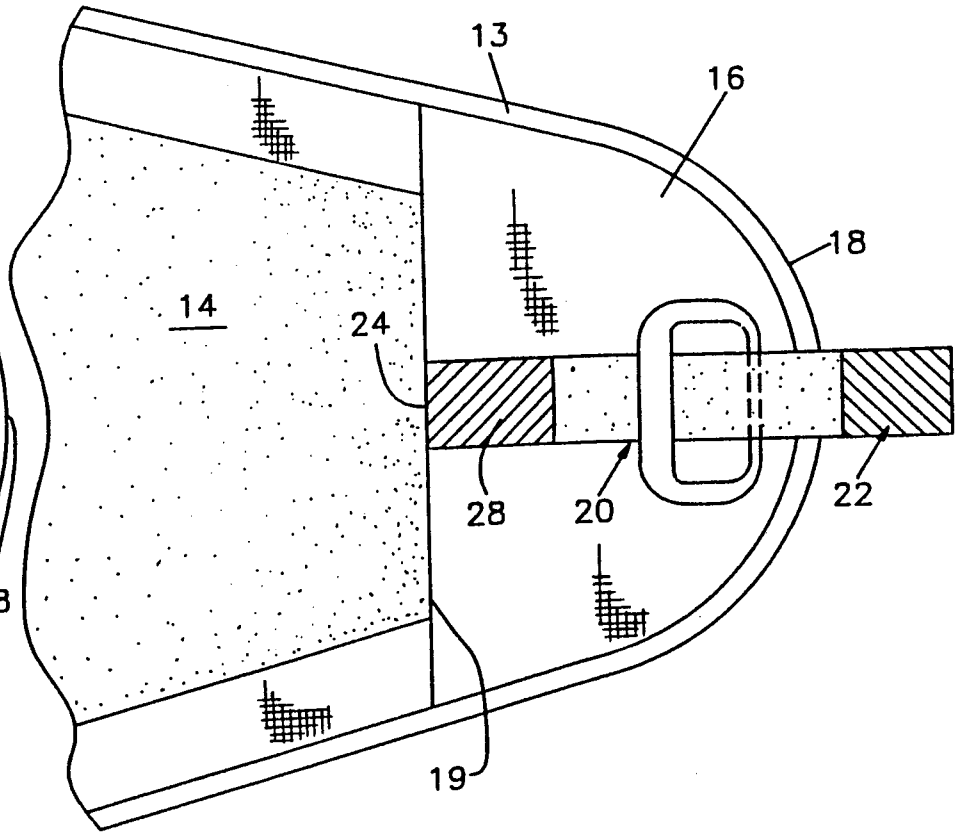
FIG. 4 is an expanded upward plan view of the front segment of the device of FIG. 2 in the untensioned mode.
Figure 3:
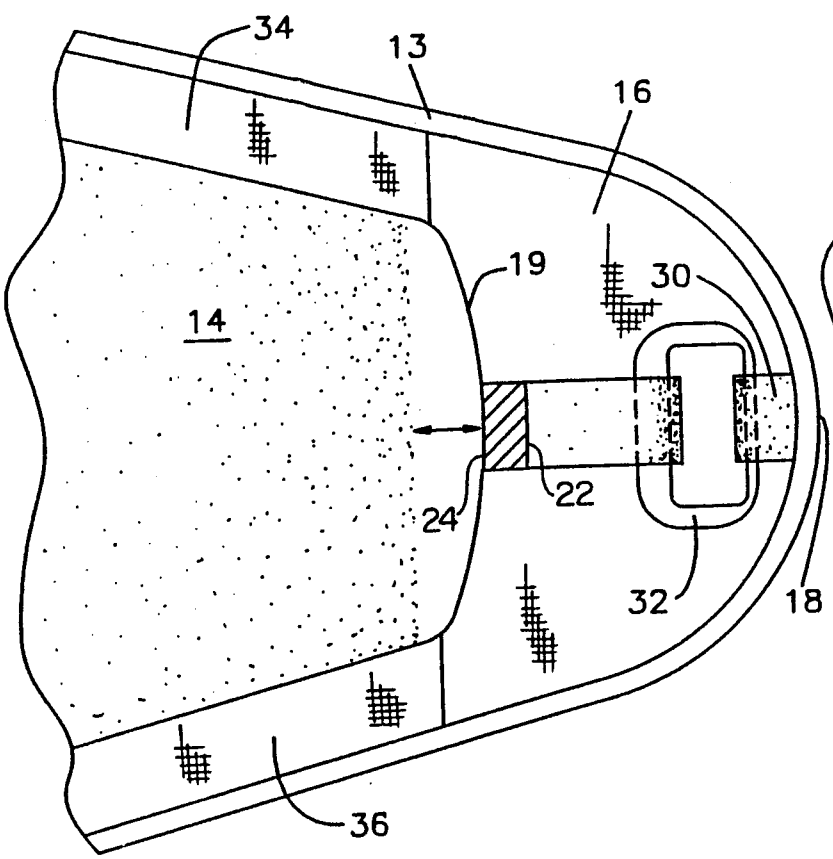
FIG. 3 is an expanded upward plan view of the front segment of the device of FIG. 2 in the tensioned mode.

FIG. 1 is a downward plan view of the ironing board cover 10 of the present invention showing the upper ironing surface segment 12 and the edge seam 13. FIG. 2 show respectively the pad 14, the front pocket 16 having a frontal nose edge 18 and a rear edge 19. A heel portion having a rear pocket 40 having a rear edge 48 and longitudinal flaps 34 and 36 intermediate said rear pocket and a front pocket and joined thereto and adapted to fold around said longitudinal edges of said board. It will be understood by those skilled in the art that while the pad 14 is usually attached to the cover 10, such attachment is not critical. In some embodiments of the invention it may be desirable the have the pad 14 as a separate but size compatible entity.

In the illustrated embodiment the outer edges of the front pocket 16, the rear pocket 40, and the longitudinal flaps 34 and 36 are joined to upper ironing surface segment 12 at seam 13. The actual widths of segments of 34, 36 and 40 are not critical their widths are those conventionally used in these covers that is to say, between two to three inches from seam 13 to the inner edge of the part in question. It has been found however that dimensions lying between $2\frac{1}{4}$ and $2\frac{3}{4}$ inches are particularly suitable.

The dimension of the nose pocket is however an integral part of the present invention. The distance between the frontal nose edge 18 and the front pocket rear edge should lie between 10 and 25% suitably, between 15 and 20% of the longitudinal axial measurement of the board that is to say, between point 18 and point 48. It has been the surprising finding of the present invention that when the distance between point 18 and edge 19 is shortened by a tensioning means the tension thus supplied to this segment of the cover transfers itself around the flaps and the rear pocket in such a way as to tighten the aforesaid portions of the cover so that they are securely held upon the board.

The actual construction of this tensioning means is not critical. However, it has been found that an especially favored mode is provided by attaching a ring means 32 by a ring attachment means 30 proximate to frontal nose edge 18. A strap 20 is attached to the front pocket proximal to rear edge 19 thereof close to end 24 of strap 20. The other, front edge 22 of strap 20 is passed through ring 32. End 22 is then looped back and attached to the strap close to the other end 24 in such a manner, that the distance between the central segment of edge 19 and frontal nose edge 18 is reduced by distance D. Where two or more straps 20 are located along rear edge 19, the location of the tensioning forces can be more precisely controlled.

The mode of such attachment is not critical provided it is secured and readily removable and adjustable. The simplest mode is utilizing a pair of mutually adhering non-adhesive surfaces such as, those generally marketed under the Trade Mark Velcro. In this modification a Velcro pad is attached at area 26 of pad 20 and its coactive surface is attached at area 28 of strap 20.

Figure 6:
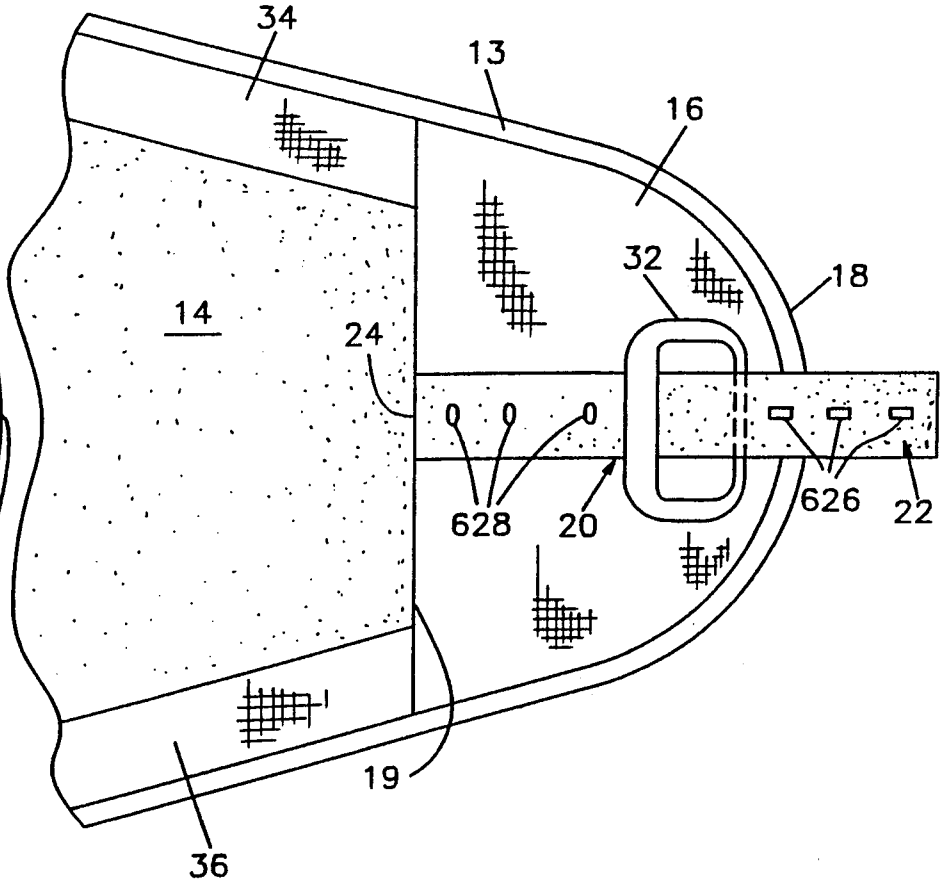
FIG. 6 is another embodiment of an expanded upward plan view of the front segment of the device of FIG. 2 in the untensioned mode.
Figure 5:
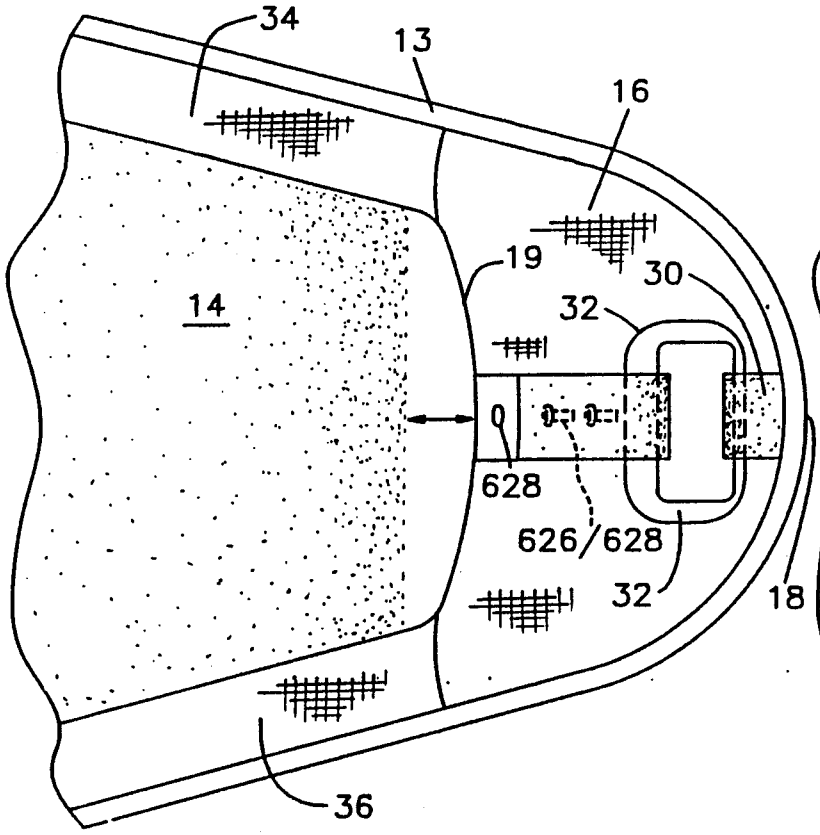
FIG. 5 is another embodiment of an expanded upward plan view of the front segment of the device of FIG. 2 in the tensioned mode.
Figure 8:
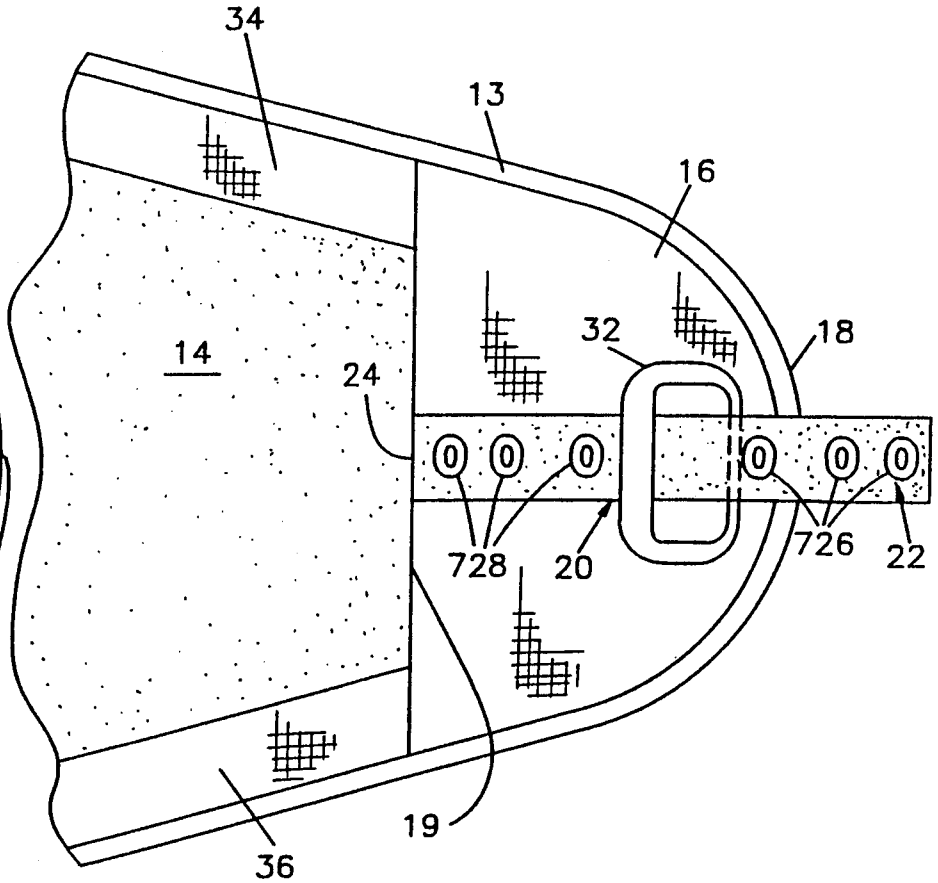
FIG. 8 is yet another embodiment of an expanded upward plan view of the front segment of the device of FIG. 2 in the untensioned mode.
Figure 7:
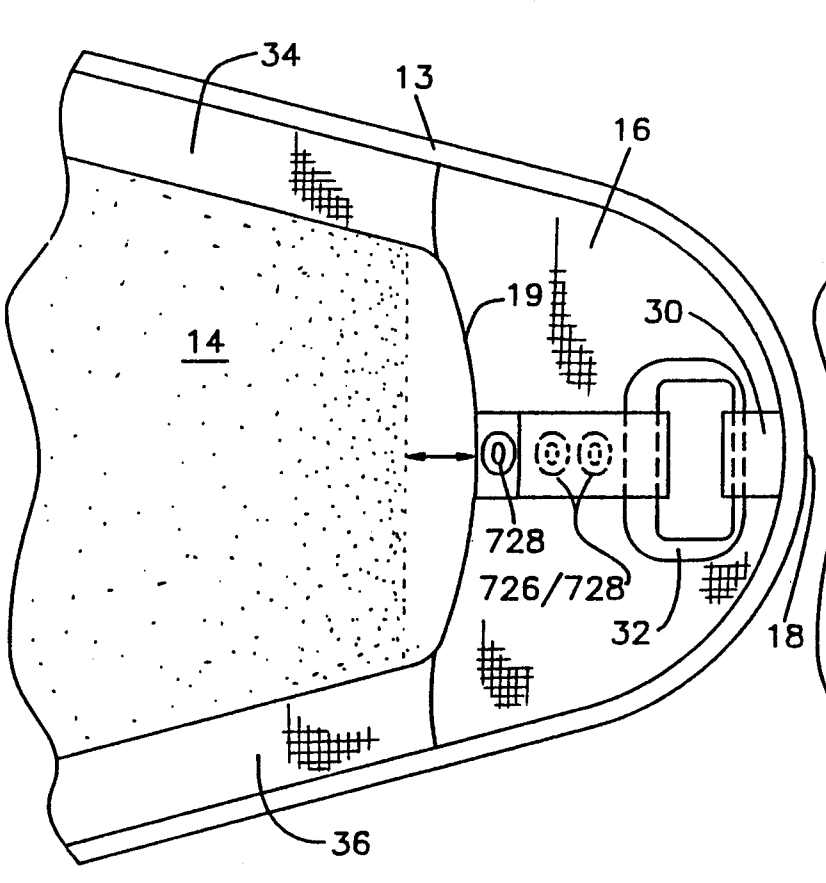
FIG. 7 is yet another embodiment of an expanded upward plan view of the front segment of the device of FIG. 2 in the tensioned mode.

In an alternate embodiment illustrated in FIGS. 6 and 7 hooks 626 may be placed proximate to end 22 of strap 20 to interact with eyes 628 placed proximal to end 24 of strap 20.

In yet another embodiment in place of hooks and eyes there may be utilized snap fasteners 728 attached proximal to end 22 and counterpart snap fasteners 728 attached proximate to end 24 of strap 20.

Figure 10:
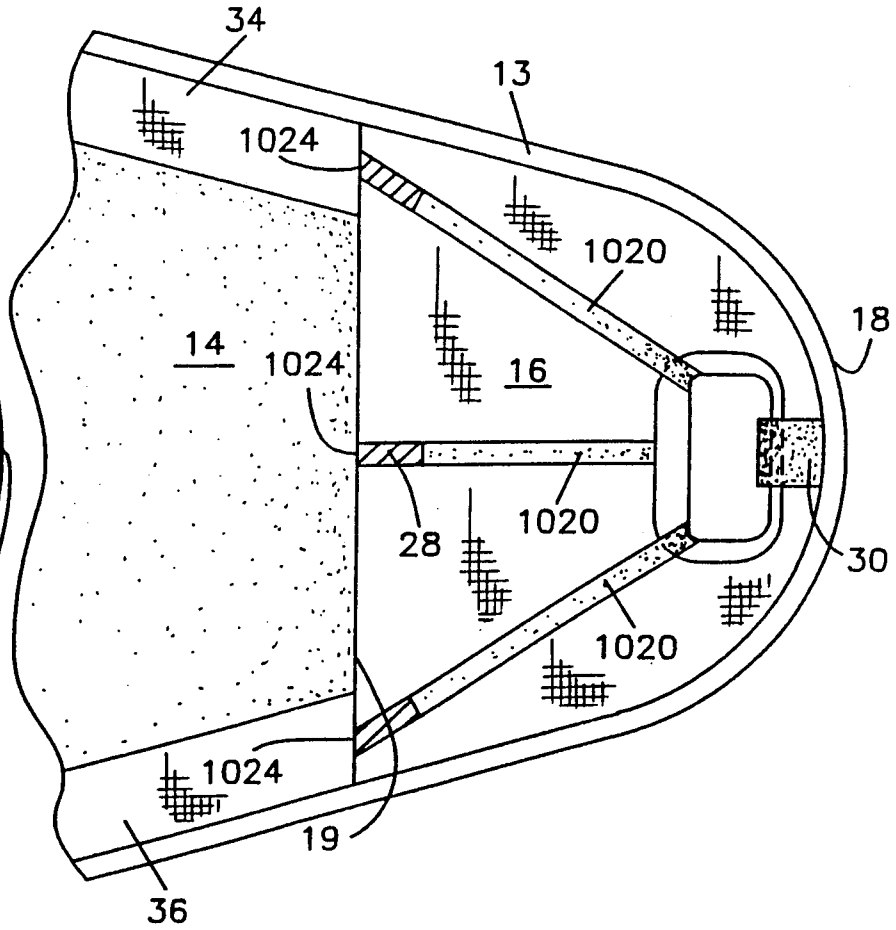
FIG. 10 is an expanded upward plan view of the front segment of a device similar to that of FIG. 2 in the tensioned mode, having three tensioning means.
Figure 9:
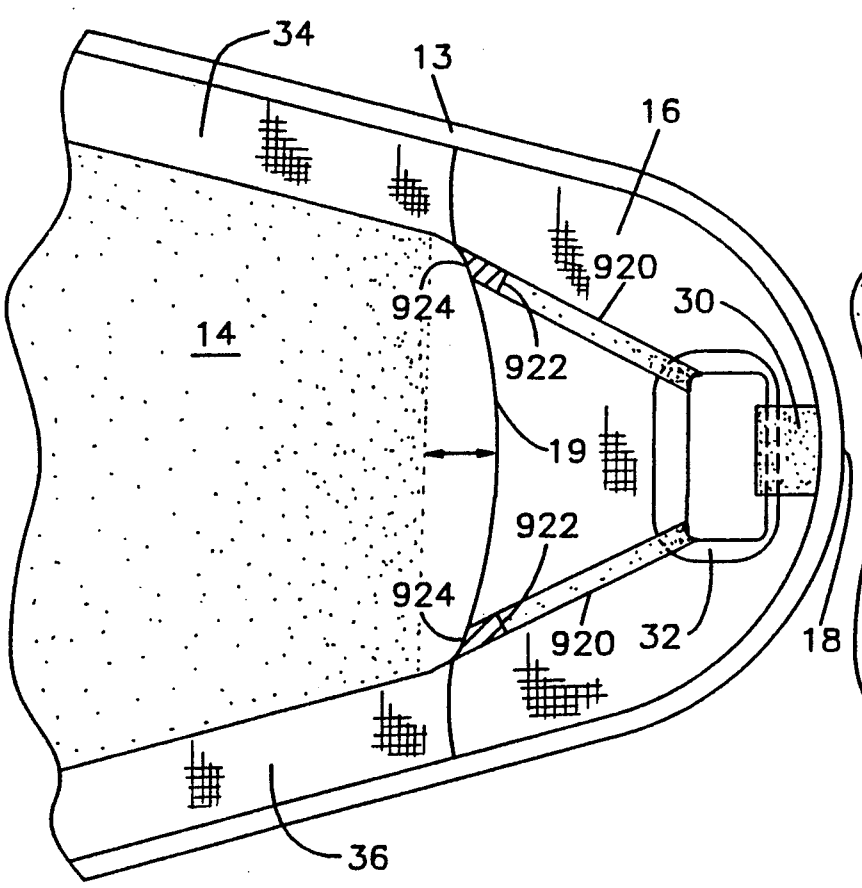
FIG. 9 is an expanded upward plan view of the front segment of a device similar to that of FIG. 2 in the tensioned mode, having two tensioning means.

A further modification is illustrated in FIGS. 9 and 10. In the former a pair of straps 920 are utilized wherein ends 924 are attached to the rear edge 19 and end 922 are looped through ring 32. In the latter three straps 1020 are utilized wherein ends 1024 are attached to the rear edge 19 and ends 1022 are looped through ring 32.

It will be understood by those skilled in the art that other methods of attaching the tensioning strap to itself, or to a similar counterpart would be well known to those skilled in the art. For example, in place of ring 32 and attachment means 30 a second interactive strap could be attached to front pocket 16 proximate to frontal nose edge 18 to interact with a shorter strap or similar surface attached proximal to rear edge 19 thereof.

I claim:

1. An ironing board cover comprising a) a top ironing surface segment shaped to fit a standard flat ironing board having top and bottom horizontal surfaces each having a nose and heel portion opposed to one another along the longitudinal axis, and a vertical peripheral side surface joining said horizontal surfaces, and said board further having a neck portion where two opposed peripheral surfaces angle toward one another and meet at a nose edge;

b) a pad segment contiguous with said top ironing surface segment, said ironing surface and pad segments together forming a composite top layer coextensive with the top horizontal surface of said board;

c) an apron portion of material depending vertically downward from the periphery of said composite layer, dimensioned to hang vertically along the peripheral side surfaces of said board to a distance at least slightly below the bottom horizontal surface of said board;

d) elastic means for drawing said apron at least partially snugly around said board's peripheral side surface and underneath said board's bottom horizontal surface;

wherein the improvement comprises e) said apron portion proximal to said board's neck portion forming an integral pocket therefor by joining portions of said apron on said two opposed sides of said neck portion to one another in an uninterrupted panel, f) tensioning means on said uninterrupted panel for adjustably tensioning a point proximal to the nose edge of said panel toward a point proximal to a rearward edge of said panel, thereby reducing a distance between said nose edge and said rearward edge of said panel, causing the entire apron to envelop said board in a proximate tensioned manner, said uninterrupted panel extending from said nose toward said heel a distance measured along said longitudinal axis of at least 10% to 25% of said board's length prior to tensioning of said panel by said tensioning means.

2. The cover of claim 1 wherein said pad segment is attached to said ironing surface segment.

3. The cover of claim 1 wherein said untensioned distance between the nose edge of said panel and the rearward edge of said panel is between about15% and about 20% of the length of said cover measured along the longitudinal axis.

4. The cover of claim 1 wherein the tensioning means comprises:

a ring attached to the lower surface of said panel proximal to the nose edge thereof, and at least one strap, having a free end and an attached end, said attached end being attached to said lower surface of said panel proximal to said rearward edge thereof, said free end of said strap being looped through said ring and removably attachable to said ring proximal to the attached end thereof, whereby when said free strap end is looped through said ring and attached to said attached end thereof, the distance between the nose edge and the rearward edge of said panel is reduced.

5. The cover of claim 4 comprising one strap, the attached end thereof being attached to the rearward edge of said panel substantially along said longitudinal axis thereof.

6. The cover of claim 4 wherein said at least one strap consists of two straps; the attached ends thereof being attached to the rearward edge of said panel.

7. The cover of claim 4 wherein the tensioning means comprise at least one hook and eye pair located respectively on the free and attached ends of said strap.

8. The cover of claim 4 wherein the tensioning means comprise at least one snap fastener and counterpart snap fastener head pair located respectively on the free and attached ends of said strap.

9. The cover of claim 4 wherein the tensioning means comprises a pair of hooked and looped surfaces located respectively on the free and attached ends of said strap.

* * * * *